US006213556B1

(12) United States Patent
Chen

(10) Patent No.: US 6,213,556 B1
(45) Date of Patent: Apr. 10, 2001

(54) EXTENDIBLE CHAIR ARM

(76) Inventor: Chao Ken Chen, No. 15-1, Fu-Kung Rd., Chung-Hua Hsien (TW)

( * ) Notice: Subject to any disclaimer, the term of this patent is extended or adjusted under 35 U.S.C. 154(b) by 0 days.

(21) Appl. No.: 09/628,237

(22) Filed: Jul. 28, 2000

(30) Foreign Application Priority Data

Jul. 31, 1999 (TW) ..... 88212915

(51) Int. Cl.[7] ..... A47C 7/54

(52) U.S. Cl. ..... 297/411.35; 297/411.37; 297/411.38

(58) Field of Search ..... 297/411.35, 411.37, 297/411.38; 248/118, 118.1, 282.1

(56) References Cited

U.S. PATENT DOCUMENTS 5,380,065 * 1/1995 Rohrer ..... 297/411.35 X
5,975,640 * 11/1999 Chen ..... 297/411.35 X
6,059,366 * 5/2000 Hu ..... 297/411.35
6,074,012 * 6/2000 Wu ..... 297/411.35 X

* cited by examiner

*Primary Examiner*—Laurie K. Cranmer
(74) *Attorney, Agent, or Firm*—Pro-Techtor International Services

(57) ABSTRACT

An extendible chair arm comprises a rail member supported by an arm stump, a sliding member disposed in rail member being moveable within a length of trough of rail member, a first pivot plate with inner end pivotably secured to sliding member by a bearing, and a second pivot plate pivotably secured to the outer end of first pivot plate. With this, arm pad supported by second pivot plate can move and pivot with respect to the chair as sliding member moves in cooperation with the rotation of first pivot plate relative to sliding member and second pivot plate for providing a support for elbow when doing office work on table. Thus prevents arm fatigue.

5 Claims, 5 Drawing Sheets

EXTENDIBLE CHAIR ARM

FIELD OF THE INVENTION

The present invention relates to chair arm and more particularly to an extendible arm used in an office chair.

BACKGROUND OF THE INVENTION

Conventionally, an arm of an office chair is either fixed or adjustable with respect to height. However, there is a gap between either type of above arms. As such, no support provided by such arms for elbow portion as one person uses for example a computer. Such elbow suspension may easily cause fatigue. This is one of the drawbacks of conventional chair arm.

An exploded view of a conventional chair arm is shown in FIG. 1 wherein rail member A is open to the top. As such, rear portion of rail member A is open when sliding member B moves forward relative to rail member A. But this is unsatisfactory for the purpose for which the invention is concerned for the following reasons:

1. Foreign objects may drop into the open portion of rail member A to clog the sliding member B. Further, it may hurt a child's fingers if child's hand is put on that open portion of rail member A.

2. Sliding member B is structurally complex. Also, a rubber block B1 is required to engage with sliding member B. Furthermore, a stopper A1 is provided in the front portion of rail member A to limit the movement of sliding member B. This results in an increase of manufacturing cost.

Thus, it is desirable to provide an improved chair arm in order to overcome the above drawbacks of prior art.

SUMMARY OF THE INVENTION

It is an object of the present invention to provide an extendible chair arm which has the feature of rail member being implemented in a closed configuration such that foreign objects may not drop into rail member to clog sliding member as well as prevent sliding member from hurting hand.

It is another object of the present invention to provide a simplified extendible chair arm for reducing the manufacturing cost.

The above and other objects, features and advantages of the present invention will become apparent from the following detailed description taken with the accompanying drawings.

DETAILED DESCRIPTION OF THE PREFERRED EMBODIMENTS

Figure 1:
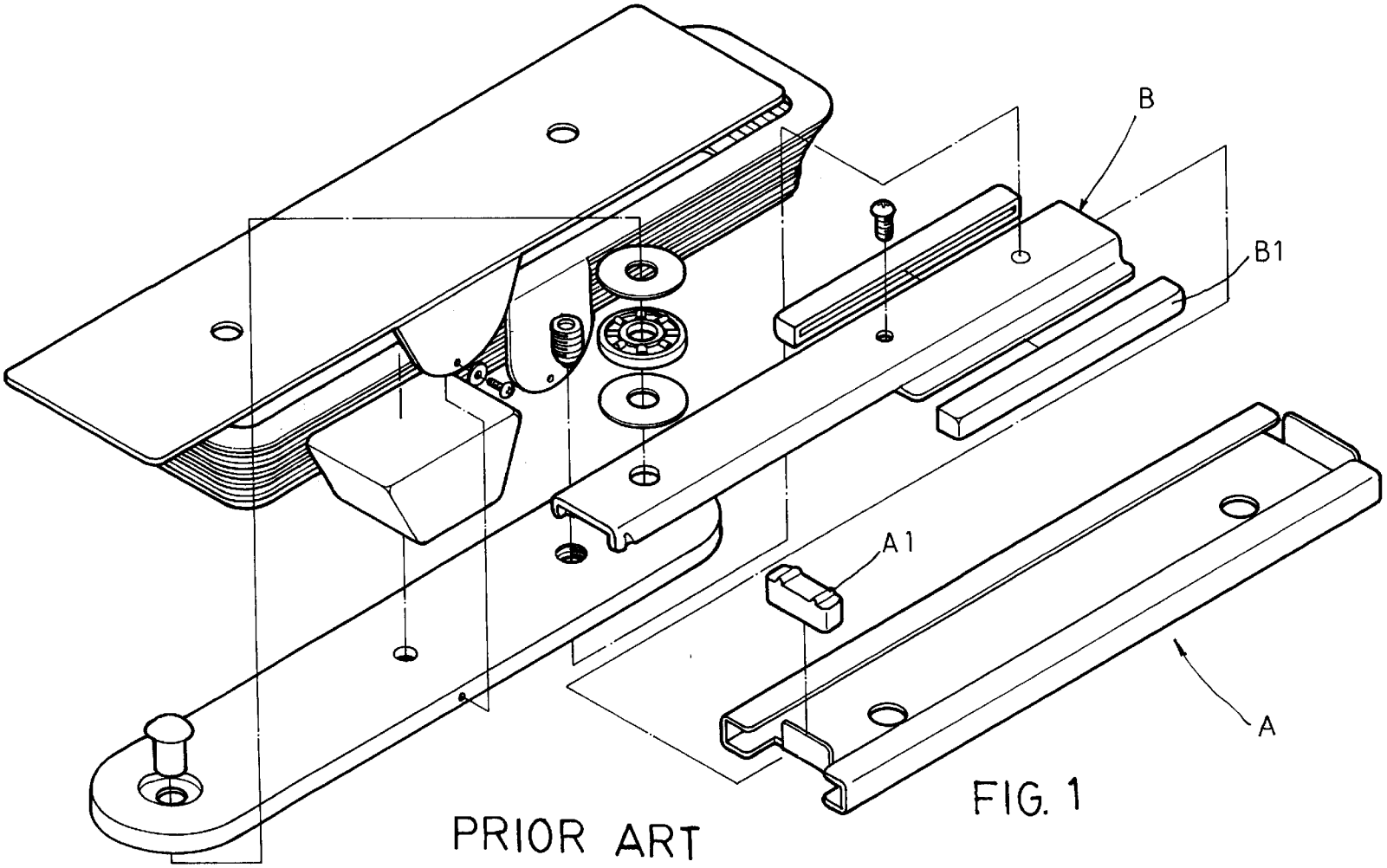
FIG. 1 PRIOR ART
FIG. 1 is an exploded view of a conventional chair arm.
Figure 2:
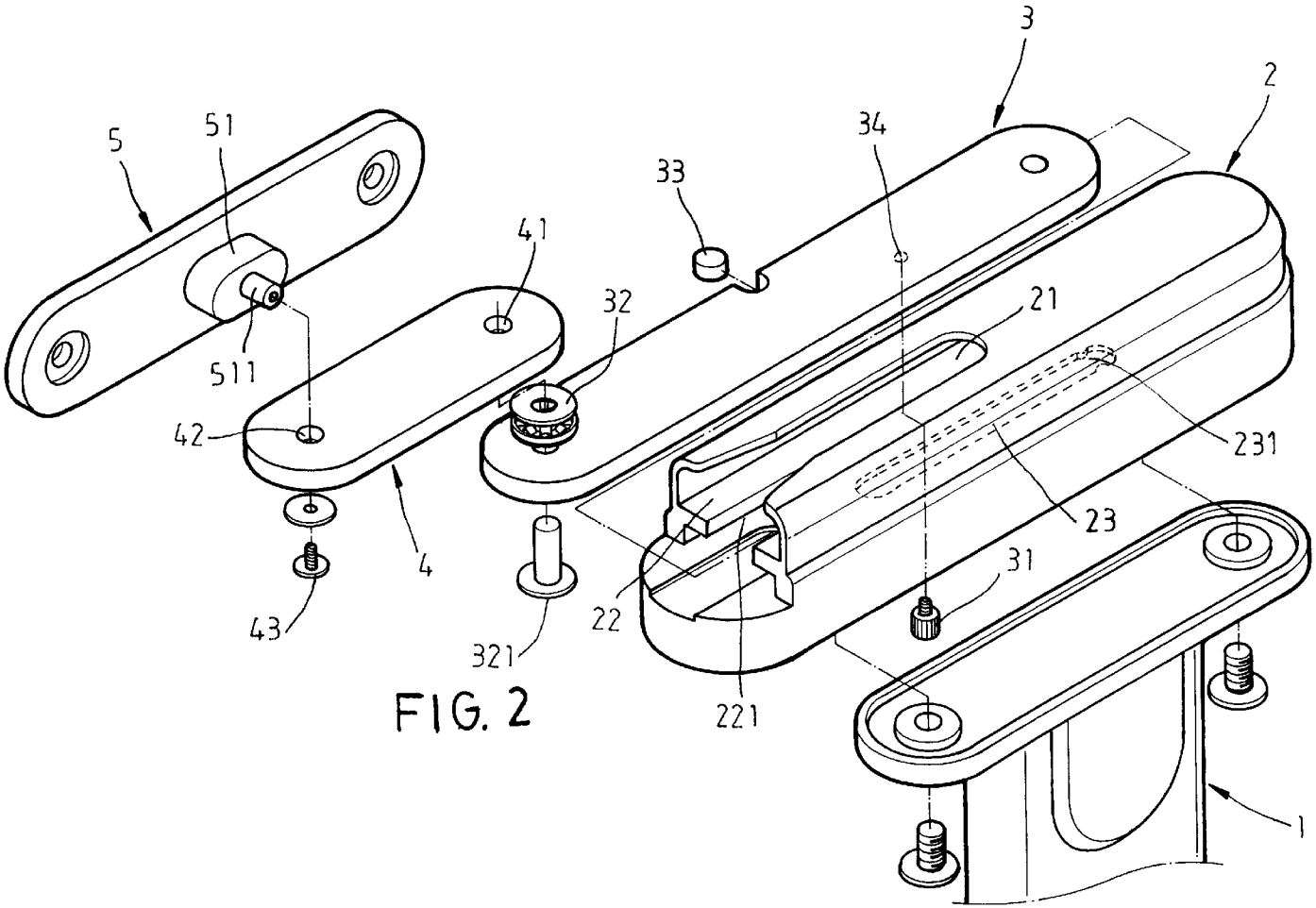
FIG. 2 is an exploded view of a preferred embodiment of extendible chair arm according to the invention.

Referring to the figures, particularly to FIGS. 2 to 7, there is shown an extendible chair arm constructed in accordance with the invention. Arm is supported by an arm stump 1. Arm comprises a rail member 2, a sliding member 3, a first pivot plate 4, and a second pivot plate 5. Description of each above component is as below.

Figure 7:
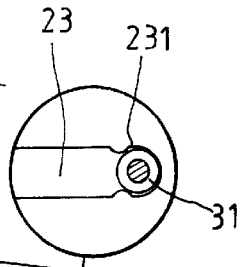
FIG. 7 is an enlarged fragmentary view of the circle area of FIG. 4 to show thumbscrew engaged in the projected aperture of trough.

Rail member 2 is an elongate hollow member open to the front including a lengthwise groove 21, a horizontal divider 22 on the inside for dividing the interior space into upper and lower portions, a recess 221 in the front end of divider 22, an elongate trough 23 in the center portion of the bottom surface of rail member 2, and a generally semicircular projected aperture 231 at the inner end of trough 23 being smaller than width of trough 23 for permitting a thumbscrew 31 to secure therein after moving from trough 23 (see FIG. 7).

Elongated sliding member 3 is slidably disposed in the lower portion of rail member 2. Thumbscrew 31 is secured to a hole 34 on the bottom of sliding member 3 after passing trough 23. As such, sliding member 3 is defined to move a maximum length of trough 23 in rail member 2. A rubber member 33 is engaged between rail member 2 and sliding member 3 to serve as a cushion to prevent a wobble of sliding member 3. A bearing 32 is provided on the top front portion of sliding member 3. The shank of pin 321 is passed through bearing 32 to pivotably secure in hole 41 near one end of first pivot plate 4. As such, first pivot plate 4 may pivot about pin 321 in 360 degrees. Another hole 42 is provided near the other end of first pivot plate 4.

Figure 3:
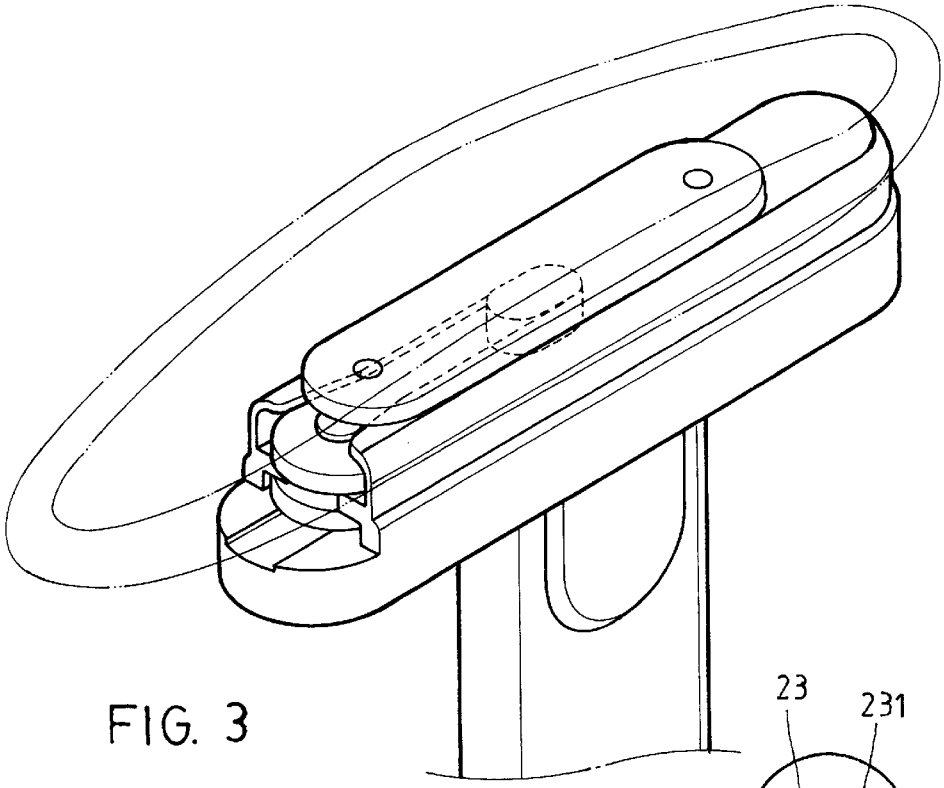
FIG. 3 is a perspective view of assembled chair arm of FIG. 2.
Figure 4:
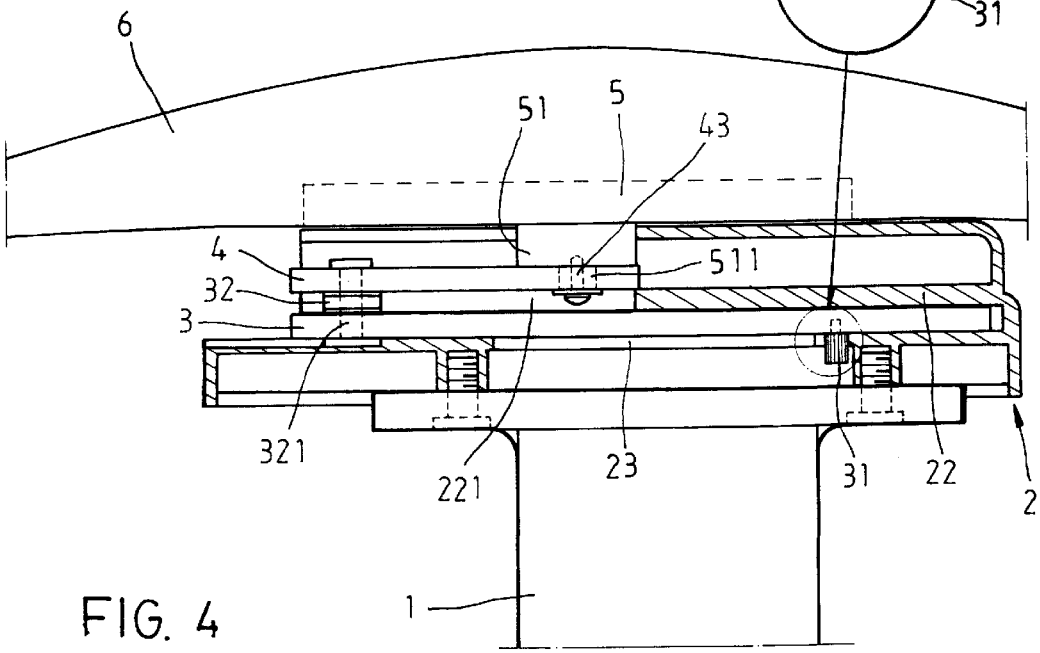
FIG. 4 is sectional view of FIG. 3.
Figure 5:
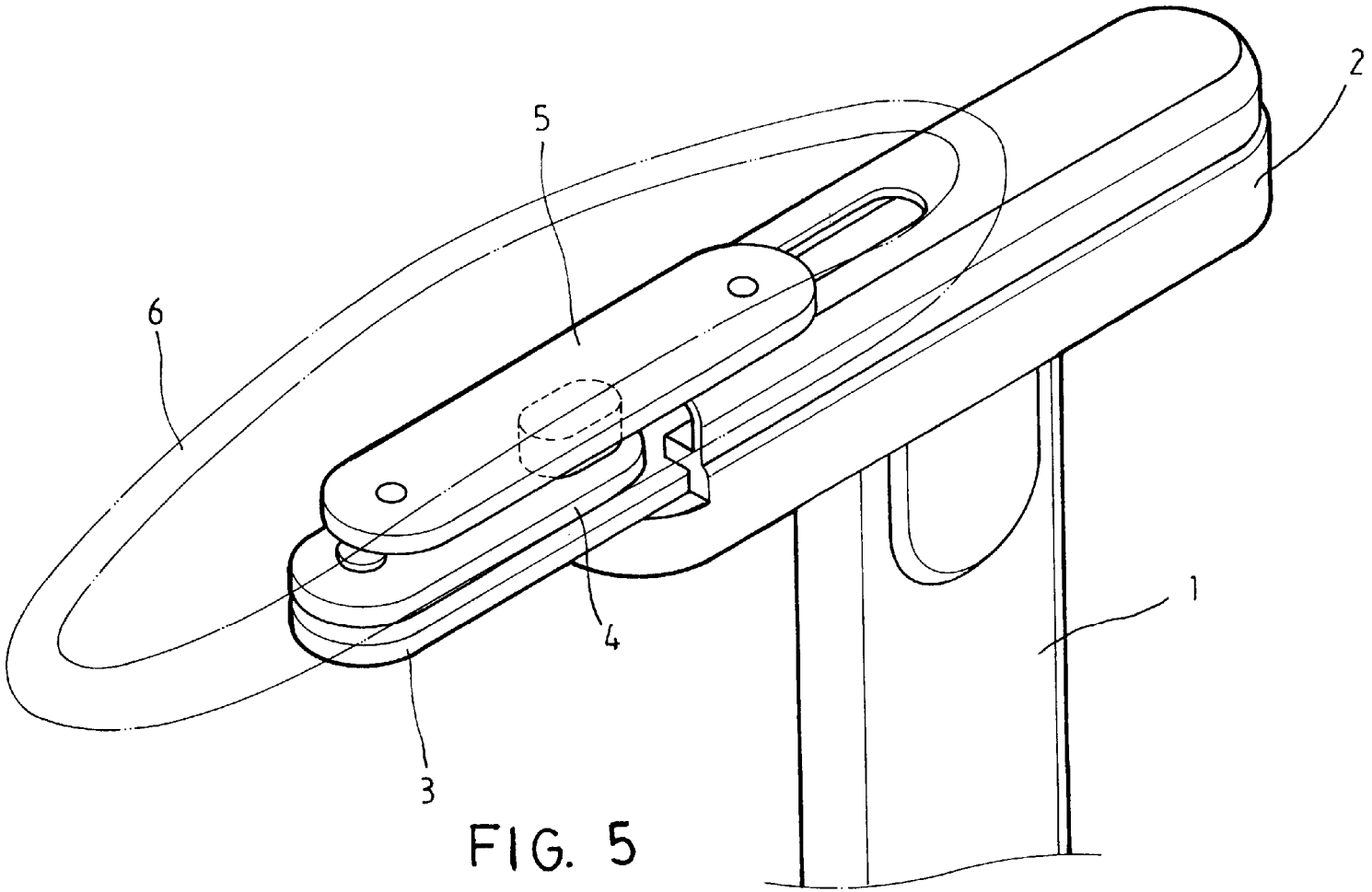
FIG. 5 is a first environmental view of chair arm of the invention where arm half extended.
Figure 6:
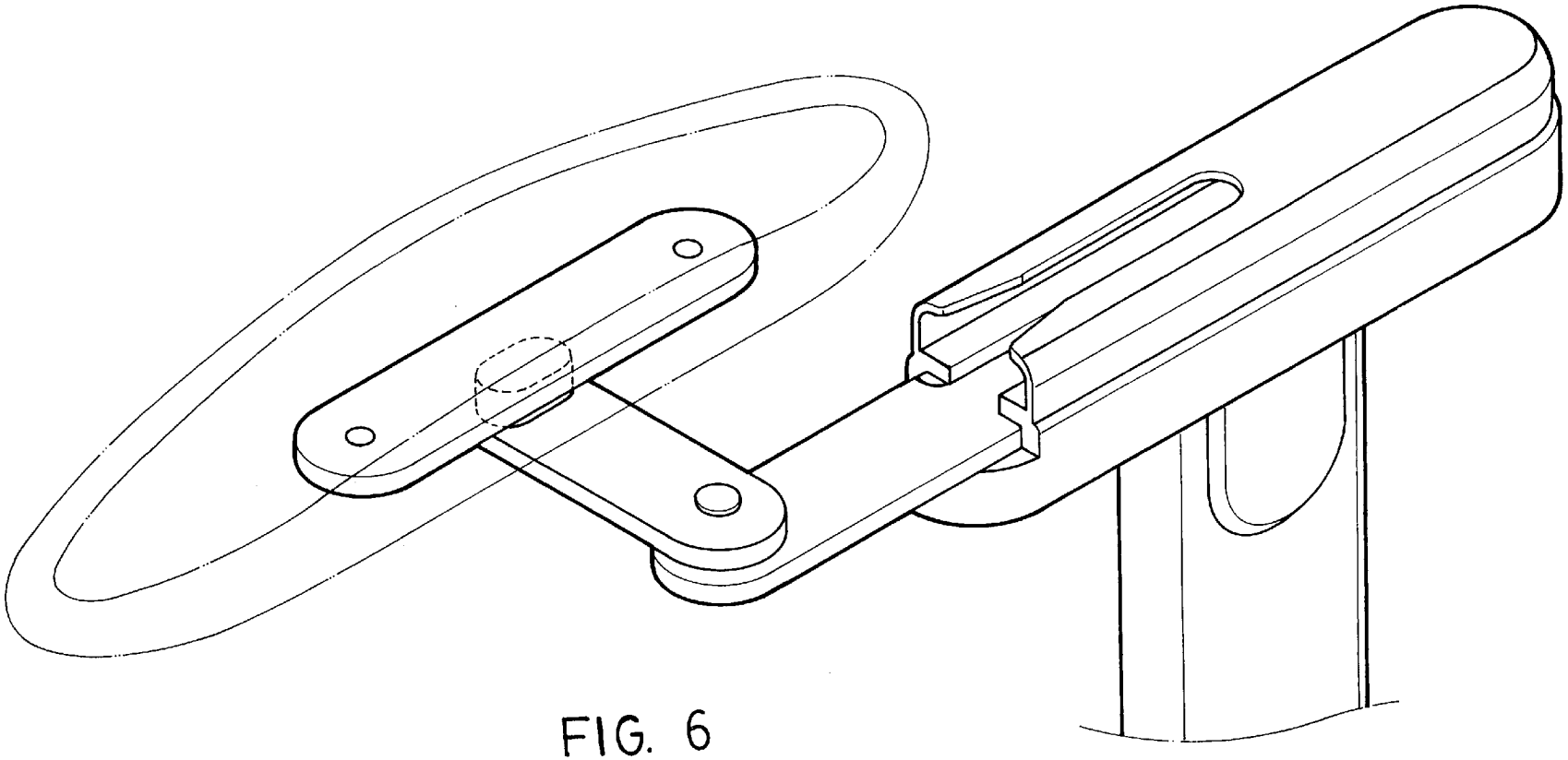
FIG. 6 is a second environmental view of chair arm of the invention where arm fully extended.

Second pivot plate 5 is provided below arm pad 6 (FIG. 4) comprising an elongate block 51 projected in the bottom and a short hollow cylindrical member 511 with internal thread provided in the bottom of block 51 wherein screw 43 is screwed through hole 42 of first pivot plate 4 to pivotably secure in member 511 such that second pivot plate 5 may freely pivot about first pivot plate 4. An assembled arm is shown in FIGS. 3 and 4. As shown in FIG. 4, bearing 32 is horizontally moveable in recess 221, first pivot plate 4 is disposed in the upper portion of rail member 2, and block 51 is horizontally moveable in groove 21. With this, arm pad 6 can move and pivot with respect to the chair (FIGS. 5 and 6) as sliding member 3 moves in cooperation with the rotation of first pivot plate 4 relative to sliding member 3 and second pivot plate 5. This provides a support is provided for elbow portion as one person uses for example a computer, thereby preventing arm fatigue. Further, no foreign objects may drop into rail member 2 to clog sliding member 3. Furthermore, it is impossible to hurt fingers when hand is put on arm.

While the invention herein disclosed has been described by means of specific embodiments, numerous modifications and variations could be made thereto by those skilled in the art without departing from the scope and spirit of the invention set forth in the claims.

What is claimed is:

1. An arm mounted on a chair comprising:

an elongate hollow rail member open to the front including a lengthwise groove, a horizontal divider on the inside for dividing the interior space into an upper and a lower portions, a recess in the front end of the divider, an elongate trough in the bottom of the rail member;

an elongated sliding member received in the lower portion of the rail member including a bearing at the front end being moveable in the recess and a thumbscrew passed through the trough to secure to the bottom of the sliding member for defining the sliding member to move in the length of the trough;

a first pivot plate deposed in the upper portion of the rail member with the inner end pivotably secured to the sliding member by the bearing;

a second pivot plate pivotably secured to the outer end of the first pivot plate;

and an arm pad supported by the second pivot plate; whereby the arm pad is capable of moving and pivoting with respect to the chair as the sliding member moves in cooperation with the rotation of the first pivot plate relative to the sliding member and the second pivot plate.

2. The chair arm of claim 1, wherein the sliding member further comprises a rubber member engaged between the rail member and the sliding member.

3. The chair arm of claim 1, wherein the sliding member further comprises a pin passed through the bearing to pivotably secure to the first pivot plate.

4. The chair arm of claim 1, wherein the second pivot plate comprises an elongate block projected in the bottom being moveable in the groove, a short hollow cylindrical member with internal thread provided in the bottom of the block, and a screw screwed through the outer end of the first pivot plate to pivotably secure in the cylindrical member of the second pivot plate.

5. The chair arm of claim 1, wherein the trough includes a projected aperture at the inner end having a diameter smaller than the width of the trough for securing the thumbscrew therein.

* * * * *